US011767138B2

(12) United States Patent
Sabato et al.

(10) Patent No.: US 11,767,138 B2
(45) Date of Patent: Sep. 26, 2023

(54) METHOD FOR CONTROLLING THE POSITION OF A MATERIAL WEB EDGE

(71) Applicant: GEA Food Solutions Germany GmbH, Biedenkopf-Wallau (DE)

(72) Inventors: Frank Sabato, Biedenkopf (DE); Jochen Rehn, Biedenkopf-Wallau (DE)

(73) Assignee: GEA Food Solutions Germany GmbH, Biedenkopf-Wallau (DE)

( * ) Notice: Subject to any disclaimer, the term of this patent is extended or adjusted under 35 U.S.C. 154(b) by 0 days.

(21) Appl. No.: 17/056,078

(22) PCT Filed: May 20, 2019

(86) PCT No.: PCT/EP2019/062938

§ 371 (c)(1),
(2) Date: Nov. 17, 2020

(87) PCT Pub. No.: WO2019/219967

PCT Pub. Date: Nov. 21, 2019

(65) Prior Publication Data

US 2021/0229849 A1 Jul. 29, 2021

(30) Foreign Application Priority Data

May 18, 2018 (DE) ..... 10 2018 207 924.2
Oct. 30, 2018 (DE) ..... 102018218582.4
Apr. 17, 2019 (DE) ..... 102019205541.9

(51) Int. Cl.
*B65B 41/18* (2006.01)
*B65B 9/04* (2006.01)
(Continued)

(52) U.S. Cl.
CPC ..... *B65B 41/18* (2013.01); *B65B 9/04* (2013.01); *B65B 41/12* (2013.01); *B65B 57/04* (2013.01)

(58) Field of Classification Search
CPC ..... B65B 57/02; B65B 57/04; B65B 41/12; B65B 41/18; B65B 9/04; B65H 23/0326; B65H 23/0216
See application file for complete search history.

(56) References Cited

U.S. PATENT DOCUMENTS 2,860,840 A * 11/1958 Jacobsen ..... B65H 23/0326 226/22
2,871,013 A * 1/1959 Markey ..... B65H 23/0212 226/22
(Continued)

FOREIGN PATENT DOCUMENTS

DE 4444228 A1 6/1996
DE 19758449 A1 3/1999
(Continued)

OTHER PUBLICATIONS

English Translation for International Preliminary Report on Patentability for International Application PCT/EP2019/062938, dated Oct. 22, 2020.
(Continued)

*Primary Examiner* — Joshua G Kotis
(74) *Attorney, Agent, or Firm* — The Dobrusin Law Firm, P.C.

(57) ABSTRACT

A packaging machine and a method for controlling the position of a lower and/or upper material web on a packaging machine. A lower material web is unwound from a supply roll and transported intermittently or continuously along the packaging machine. Packaging recesses are optionally formed in the lower material web in a forming station, and the lower material web, preferably the packaging recesses, are then filled with products to be packaged. An upper material web is then sealed to the lower material web
(Continued)

in a sealing station, the lower and upper material web each being unwound from a supply roll.

11 Claims, 3 Drawing Sheets

(51) Int. Cl.
*B65B 41/12* (2006.01)
*B65B 57/04* (2006.01)

(56) References Cited

U.S. PATENT DOCUMENTS 3,225,988 A * 12/1965 Drenning ..... B65H 23/0204 226/19
3,232,547 A * 2/1966 Thiede ..... B65H 23/0326 226/20
3,592,372 A * 7/1971 James ..... B29C 53/52 226/22
3,762,125 A * 10/1973 Prena ..... B65B 7/164 226/27
4,054,251 A * 10/1977 Henderson ..... B65H 23/0326 226/15
4,913,366 A * 4/1990 Andou ..... B65H 26/08 242/563.2
6,044,615 A * 4/2000 Fukuda ..... B65B 59/003 53/64
2004/0123568 A1* 7/2004 Send ..... B65B 41/18 53/64
2005/0061419 A1 3/2005 Send
2007/0209320 A1* 9/2007 Grzonka ..... B65B 41/18 53/64
2013/0025243 A1* 1/2013 Spix ..... B65B 57/02 83/13
2013/0193254 A1* 8/2013 Capriotti ..... B65B 57/18 242/563.2
2014/0150377 A1* 6/2014 Ehrmann ..... B65B 47/02 53/559
2014/0249007 A1* 9/2014 Ehrmann ..... B65B 41/14 493/102
2015/0096263 A1* 4/2015 Ehrmann ..... B65B 61/025 53/411
2015/0135650 A1* 5/2015 Lau ..... B65B 59/003 53/561
2018/0057199 A1* 3/2018 Aiello ..... B65B 55/04

FOREIGN PATENT DOCUMENTS

DE 102012001816 A1 8/2013
DE 202016100802 U1 5/2016
EP 1160167 A2 12/2001
EP 3142952 A1 3/2017
GB 1296251 A 11/1972

OTHER PUBLICATIONS

International Search Report and Written Opinion for Application PCT/EP2019/062938, dated Aug. 2, 2019.

* cited by examiner

METHOD FOR CONTROLLING THE POSITION OF A MATERIAL WEB EDGE

FIELD

The present invention relates to a packaging machine and to a method for controlling the position of a lower and/or upper material web on a packaging machine.

BACKGROUND

In the generic method, the lower material web is generally transported along the packaging machine by two endless chains or endless toothed belts, on each of which there are holders which hold the lateral edge of the lower material web. Those skilled in the art will know that material webs have tolerances in their width and that material webs extend approximately transversely to the transport direction, that is to say are not aligned parallel to their transport direction. In the extreme case, this leads to the holders on the transport chains no longer or no longer sufficiently gripping the material web, which leads to a production stoppage.

SUMMARY

The object of the present invention was, therefore, to provide a method which does not have the disadvantage of the prior art.

The object is achieved by a method for controlling the position of a lower and/or upper material web on a packaging machine, wherein the lower material web is unwound from a supply roll and transported intermittently or continuously along the packaging machine, packaging recesses are optionally formed in the lower material web in a forming station, and the lower material web, preferably the packaging recesses, are then filled with products to be packaged, an upper material web is then sealed to the lower material web in a sealing station, the lower and upper material web each being unwound from a supply roll, wherein the position of a reference point on the lower and/or the upper material web relative to a preferably stationary component of the packaging machine is detected and, on the basis of this detection, the position of the lower and/or the upper material web transversely to its transport direction is changed if necessary.

The present invention relates to a method which is carried out on a packaging machine in which a lower material web, in particular a plastic material web, which preferably has a width between 200 mm and 1 m and more, is unwound from a supply roll and preferably transported intermittently/cyclically in a transport direction along the packaging machine. In a forming station which may be present, said lower material web is firstly heated and packaging recesses are formed in the lower material web by means of a deep-drawing tool. As a rule, multiple packaging recesses, which are arranged in a so-called format, are formed at the same time and subsequently transported simultaneously along the packaging machine. After that, the lower material web, preferably each packaging recess, is filled/covered with a product to be packaged, preferably a format of products to be packaged, in particular a food such as, for example, sausage, ham or cheese and, in a next step in a sealing station is connected to an upper material web, the upper material web generally being sealed to the lower material web. Those skilled in the art will understand that the product to be packaged can also be filled/placed in an unformed material web. Then, the thus finished package is separated. The upper material web is likewise unwound from a supply roll.

Downstream of at least one supply roll in relation to the transport direction of the respective material web, there can be a dancer, which keeps the tension in the material web at least substantially constant.

The material web can be, for example, a paper, paperboard and/or plastic film web. The material web can consist of multiple layers. As a rule, the lower and upper material web differ in their structure. Each material web can be transparent, translucent or opaque. Each material web can be printed. The lower and/or the upper material web can be deep-drawn.

The package which is produced by the method according to the invention can have an intermediate layer. The entire disclosure which is made for the upper and the lower film and the control of their position transverse to the longitudinal direction of the packaging machine and/or transverse to the position of the lower and/or upper material web also relates to the intermediate layer web.

According to the invention, at least one material web has one or more reference points, with which the transverse position of the respective material web, i.e. vertically and/or horizontally to its transport direction and relative to a preferably stationary component of the packaging machine, can be detected. As a result, it is possible to detect whether the material web is running out laterally, i.e. transverse to the transport direction, i.e. its transport direction is not aligned parallel to the packaging machine, in particular the frame and/or chain run thereof or, although it is running parallel to the transport direction, for example the supply roll of the material web exhibits a lateral offset relative to the reference point. Alternatively or additionally, by using the reference points it is possible to determine whether the nominal width of the material web changes. Material webs, in particular material webs of lower quality, exhibit deviations from their parallelism relative to the transport direction of the material web. This deviation can likewise be determined by using the reference point(s).

One possible reference point is, for example, at least one of the two edges of the material web. In addition, preferred reference points are printed marks, which are preferably applied to and/or incorporated in the material web at regular intervals. Furthermore, a print, for example a logo, on the material web can serve as a reference point.

A reference point in the sense of the invention can have any shape and size. Preferably, the reference points are repeated at, in particular, regular intervals.

On the basis of this detection of the position of the reference point, the position of the material web, in particular downstream of the location of the detection of the reference point transverse to the transport direction of the material web, is changed if the just determined position of the reference point is located outside a specific range. The transverse position of the material web is changed, based on the transport direction of the material web preferably upstream of the location at which the position of the reference point is determined.

The position of the material web transverse to its transport direction can be changed in any manner familiar to those skilled in the art. Preferably, the supply roll is displaced along its axis of rotation. This can be done by the axis of rotation itself being provided axially movably and/or by the supply roll being displaced relative to the axis of rotation on which it is mounted. Normally, the axis of rotation will be arranged horizontally and at a 90° angle to the transport direction of the material web. In order to change the position of the material web, however, the supply roll can be provided such that it can rotate, rotatably about at least one, for example vertical and/or horizontal, axis.

Alternatively or additionally, the material web downstream of the supply roll can wrap at least partly about at least one, preferably more, rollers. This roller or rollers is/are preferably located between the supply roll and the detection of the reference point. In order to change the position of the material web, this roller or rollers is provided such that it can rotate about an in particular vertical axis.

Preferably, the reference point is detected by a sensor. Said sensor is preferably an optical or ultrasonic sensor or a touch sensor which, in particular as regards its alignment transverse to the transport direction of the material web, is preferably provided in a fixed location. Furthermore, the sensor can, for example, be a sensor which emits waves in the direction of the surface of the material web and which are at least partly reflected from the material web, the wave reflected from the material web having a wavelength that is changed with respect to the emitted wave, and the extent of the wavelength change being a measure of the change in position of the material web (Doppler effect). The sensor preferably detects deviations of the reference point in two directions, for example to the right and to the left transverse to the transport direction of the material web. Its exact position transverse to the transport direction can preferably be input into a control/regulation system. Alternatively or additionally, its distance from a reference of the packaging machine, for example the mid-axis of the latter in the direction of longitudinal extent, of the frame of the packaging machine and/or the position of one or more chain runs can be entered. The sensor can, however, also be calibrated to a specific position of the reference point and then detects deviations from this position in two directions without its exact position having been specified.

The sensor detects the reference point/s after the respective material web has been unwound. According to a preferred embodiment, the sensor is located immediately adjacent to the film roll, in particular when the latter has its maximum diameter. According to another preferred embodiment, the sensor is located in the entry region of the chain run, i.e. where the grippers of the chain clamp the edge of the material web. According to a further preferred embodiment, the sensor is located between the supply roll and the entry region of the chain run. Also preferably, a combination of at least two sensors is arranged at preferably different positions between the supply roll and entry region of the chain run, for example to determine position deviations at different locations and, for example, therefrom to detect trends in the run-out and/or effects of the changes of position and then to correct the changes of the position. Also preferably, a sensor is provided upstream of the sealing station, preferably immediately upstream of the sealing station, to detect the position of the upper material web relative to the position of the lower material web, so that the control system can act in the event of significant deviations, for example to align a printed image and/or a deep-drawn form on the upper material web with the position of the product to be packaged and/or the packaging recesses on/in the lower material web in the transverse direction. Those skilled in the art will understand that the position of the upper material web and, if appropriate, trends for the running behavior can also be detected by more than one sensor.

The signal from the sensor is transmitted to a control/regulating system, which evaluates the signal and, if necessary, changes the position of the lower and/or upper material web transverse to its transport direction.

Preferably, the material web edge, one, in particular multiple, printed mark(s) and/or one, in particular multiple, printed image/s, in particular the edge of a printed image and/or the surface of the material web is detected as reference point.

Preferably, the distance between the reference point and the center of the packaging machine, the frame of the packaging machine and/or the chain run is detected by the control system. These values can then be used to control/regulate the position of the material web transverse to its transport direction.

Preferably, the sensor is vertically and/or longitudinally adjustable. As a result, for example, account can be taken of the decreasing diameter of the supply roll, in particular if the sensor is located in the region of the supply roll.

Preferably, a run-out of the material web is corrected by the method according to the invention.

Also preferably, deviations of the nominal width of the material web can be compensated by the method according to the invention. Alternatively or additionally, deviations of the parallelism of the material web relative to its transport direction can be compensated. For example, the edges of the material web are often not straight but wavy. These defects during the production of the material web can be compensated by the method according to the invention such that no interruption to the packaging production process occurs.

The method according to the invention is also suitable to equalize inhomogeneities in the material web. Inhomogeneities of this type, for example in the thickness and/or in the composition of the material web, lead to run-out of the material web, which can be compensated by the method according to the invention.

By using the position of at least one reference point, the transverse position of the material web roll can also be detected and, if necessary, corrected. This function is of interest, in particular during a roll change. The sensor detects the position, for example of one of the first reference points. After that, the transverse position of the material web roll is corrected, if necessary. For example, the target position of the material web roll and/or its actual position relative to a tolerance window is displayed, preferably after the material web roll has firstly been placed roughly on its axis of rotation and the start of the material web has been brought into its transfer position, in that, for example, it is attached to the end of the previous material web, and the new material web is subjected to an average longitudinal tension and, if necessary, the actual position of the material web roll has been detected, after which the position of the material web roll is corrected if necessary, preferably until the displayed target position has at least approximately been reached or the actual position is located sufficiently accurately within the tolerance window. The display of the target position and/or actual position can be carried out, for example, by means of optical displays on or in the vicinity of the axis of rotation of the material web roll and/or on the control panel and/or on a display. Preferably, before the insertion of a film roll, the axis of rotation is preferably moved into a position, preferably centered with regard to the adjustment travel of the actuating drives, by using the target position of the material web roll, such that the usually limited adjustment travels of the actuating drives permit axial displacement of the axis of rotation or of the supply roll relative to the axis of rotation without the limits of the adjustment travels having to be exceeded.

Preferably, a trend analysis is carried out by using the data determined by the sensor. Preferably, it is determined whether in the run-out there is a preferred direction in which the run-out takes place. By using this analysis, it is then possible, for example, for a change to be made to the packaging machine. By using the analysis, it is also possible to investigate whether the run-out is batch-dependent and, if so, it can be determined with the respective producer what causes the run-out and how this defect can be rectified. A run-out can, for example, lie in a non-constant thickness of the material web and/or that the material web has not been stretched uniformly. However the trend analysis can also point to fluctuations in the width of the material web and/or the fact that the edges of the material web do not extend parallel to its transport direction but, for example, in a curve, in particular in a sine or cosine shape.

The data determined by the sensor/s can also be used to rectify an error message and/or for a machine stop. For example, an error message or a machine stop can be made if:

- the lateral adjustment range of the regulating system has been reached or exceeded,
- a detected trend cannot be stopped or reversed,
- if the sensors detect that a material web with a wrong width has been put in place,
- if the result of the detected data is that the material web is of lower quality and/or
- if the result of the detected data is that the material web has not been mounted correctly on the shaft of the packaging machine, for example in a wrong axial position.

Preferably, the error messages are detected and analyzed per unit time. This analysis can be used to avoid defects and/or improve the quality of the material web. For example, the tolerance in the material web can be reduced and/or the parallelism to the transport direction can be improved.

Preferably, a sensor is arranged in the region of both edges of the material web. Therefore, for example, the width of the material web can be checked, in particular checked repeatedly as the material web is unwound. By using the two sensors, a deficiency in parallelism relative to the running direction of the material web can be determined. If possible, this deficiency is compensated.

BRIEF DESCRIPTION OF THE DRAWINGS

The inventions will be explained below by using FIGS. 1 to 4. These explanations are merely exemplary and do not restrict the general idea of the invention. The explanations apply equally to all the subjects of the present invention.

DETAILED DESCRIPTION

Figure 1:
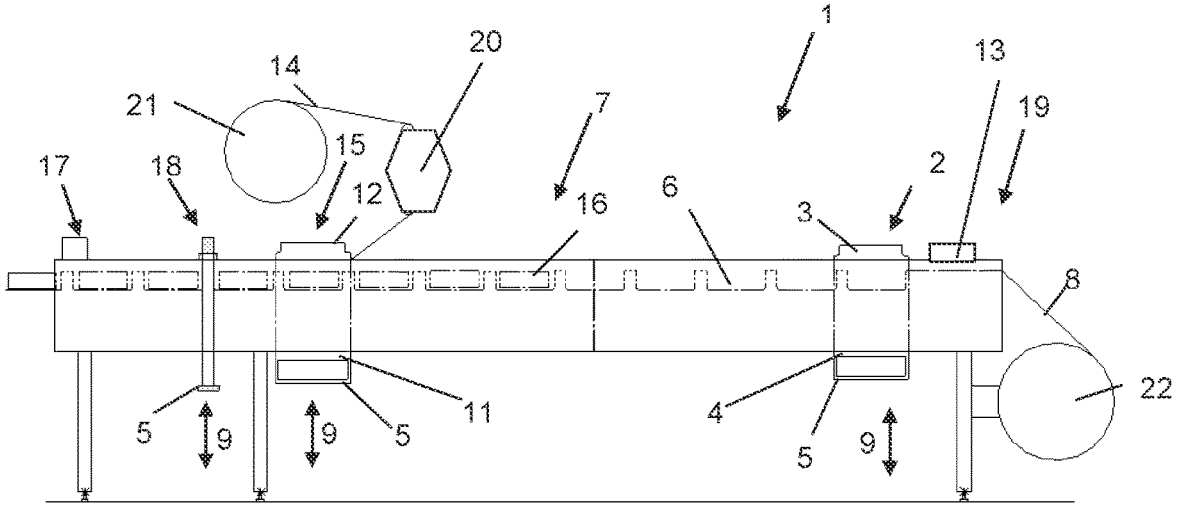
FIG. 1 shows the packaging machine according to the invention.

FIG. 1 shows the packaging machine 1 according to the invention, which here has a deep-drawing station 2, a filling station 7 and a sealing station 15. A lower material web 8, here a plastic material web 8, is drawn off a supply roll 22 and transported cyclically from right to left in its transport direction 40 along the packaging machine. During one cycle, the lower material web 8 is transported onward by a format length/feed length. For this purpose, the packaging machine has two transport means 24 (not shown in FIG. 1); in the present case respectively two endless chains, two chain runs, which are arranged on the right and left of the lower material web 8. Both at the start and at the end of the packaging machine, at least one gearwheel, around which the respective chain is deflected, is respectively provided for each chain. At least one of these gear wheels is driven. The gear wheels in the entry region and/or in the exit region can be connected to each other, preferably by a rigid shaft. Each transport means has a multiplicity of clamping means 42 (cf. FIG. 3), which grip the lower material web 8 in the entry region 19 in a clamping manner and transmit the movement of the transport means to the lower material web 8. In the exit region of the packaging machine, the clamping connection between the transport means and the lower material web 8 is released again. Downstream of the entry region 19, a heating means 13 can be provided, which heats the material web 8, in particular when the latter is at a standstill. In the deep-drawing station 2 which may be present and which has an upper tool 3 and a lower tool 4 which has the shape of the packaging recess to be produced, the packaging recesses 6 are formed in the possibly heated material web 8. The lower tool 4 is arranged on a lifting table 5 which, as symbolized by the double arrow, is vertically adjustable. Before each material web feed, the lower tool 4 is lowered and then raised again. In the further course of the packaging machine, the packaging recesses or a flat lower material web is/are filled/covered with the product to be packaged 16 in the filling station 7. In the sealing station 15 which then follows and which likewise comprises an upper tool 12 and a vertically adjustable lower tool 11, an upper material web 14 is fixed integrally to the lower material web 8 by sealing. As a result, the movement of the lower material web 8 is transmitted to the upper material web 14. In the sealing station, too, the upper tool and/or the lower tool are lowered and raised before and after each material web transport. The upper film 14 can also be guided in transport means or transported by transport chains, these transport means then extending only before the sealing station and possibly downstream. Otherwise, the explanations given in relation to the transport means of the lower film apply. The upper film can also be heated by a heating means and deep-drawn. For the sealing, a heatable sealing frame, for example, is provided as the lower tool 11, which has an opening for each packaging recess, into which the packaging recess dips during the sealing, i.e. during the upward movement of the lower sealing tool. For the sealing, the upper and the lower material web are pressed together between the upper and lower tool 12, 11 and are connected under the influence of heat and pressure. After the sealing, the tools 11, 12 are moved apart vertically again. Between the supply roll 21 and the sealing tool, a dancer 20, here a rotating dancer, can be provided, which keeps the material web 14 as far as possible at a constant tension. Those skilled in the art will understand that a plurality of upper material web/intermediate layers can be present, for example in a multilayer package or a package having multiple upper material webs. Preferably, a dancer is then provided in the run of each upper film. Those skilled in the art will also understand that a dancer can preferably be provided in the region of the lower film as well, preferably downstream of the supply roll 22. The dancer is preferably a linear dancer. Before and/or during the sealing of the upper film to the lower film, a gas exchange is preferably carried out in each packaging recess. For this purpose, the air present in the packaging recess is firstly partly extracted and then replaced by a replacement gas. For this purpose, in the region of each format in the lower film in the region of the transport chains, holes are introduced into the lower material web, through which the air between the material webs 8, 14 is extracted and the replacement gas is then blown in. In the further course of the packaging machine, the finished packages are separated, which in the present case is carried out by the cross-cutter 18 and the longitudinal cutter 17. In the present case, the cross-cutter 18 can likewise be raised and lowered by a lifting device 9.

Preferably, at least one supply roll 21, 22 is driven by a motor, in particular a torque motor, such that the length of the respectively needed feed of the respective material web is unwound from the roll without the tensile force of the two transport means, the transport chains and/or of the tensile force of the lower material web being transmitted noticeably to the upper material web. As a result, the respective material web is subjected to only a comparatively low tension and is thus slightly pre-stretched, if need be, and develops fewer creases.

With the method according to the invention, even comparatively thin material webs and/or material webs with a low quality as regards in particular homogeneity in relation to shape and/or composition can be processed.

Preferably, the rotation of the motor that drives the supply roll 21, 22 is controlled/regulated by a computer means, which can be part of the packaging machine or part of a line control system. In particular, the rotational speed of the supply roll can be controlled such that the unwound material web length corresponds to the feed, and/or the speed profiles of the unwind of the material web and/or of the feed of the transport means, in particular the transport chains, is at least substantially identical. The respective actual diameter or the respective actual weight of the supply roll is taken into account.

Preferably, the dancer is provided with a movement transmitter, for example a rotary encoder or a linear encoder, with which it is possible to determine that stored material web length which corresponds to the movement of the dancer. This information can be used, for example, to determine the diameter of the supply roll.

Preferably, a dancer is provided in the region of the lower and the upper material web. Preferably, the supply roll of the lower material web and/or the upper material web is driven by a motor such that the respective material web is unwound by a motor drive such that the respective material web is insubstantially tensioned if need be.

Figure 2:
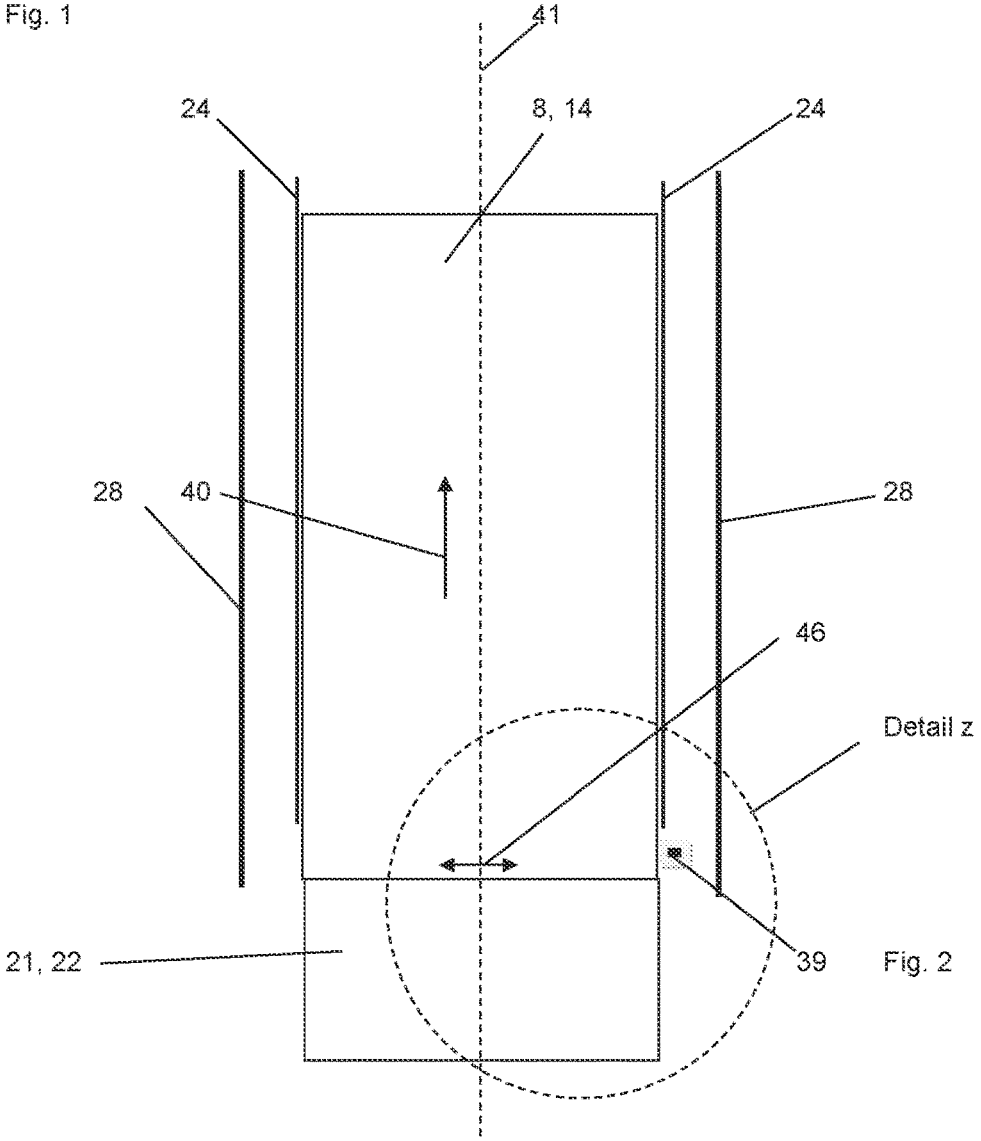
FIG. 2 shows a first embodiment of the method according to the invention.
Figure 3:
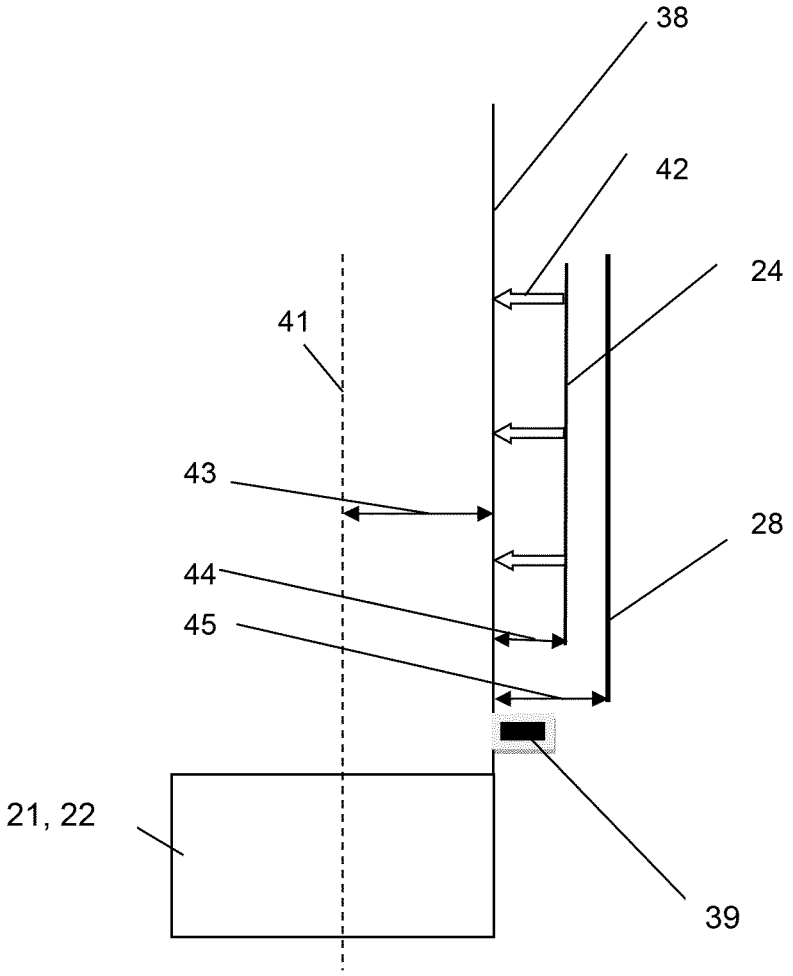
FIG. 3 shows the detail Z from FIG. 2.

FIGS. 2 and 3 show a first embodiment of the method according to the invention, a detail from FIG. 2 being illustrated in FIG. 3. A material web 8, 14 is unwound from a roll 21, 22 and transported in a transport direction 40. For various reasons, it is possible for a run-out 46 of the material web transverse to its transport direction 40 to occur, which is controlled away in a compensatory manner by the method according to the invention. For this purpose, the packaging machine has an in particular stationary sensor 39 fixed to the machine frame, which detects the position of one or more reference points. By using this measurement, a control system can determine whether the material web is running out and/or whether the reference point is located in an acceptable range relative to a component of the packaging machine. The reference point is, for example, the material web edge 38, a printed mark or a printed image. By way of example, the distance 43 between the reference mark and the mid-axis 41 of the packaging machine is determined and/or the distance 44 between the reference mark, here the edge of the material web, and the chain run and/or the grippers 42 of the latter is determined. Alternatively or additionally, the distance of the reference mark from the machine frame 28 can also be determined. By using the signal from this sensor 39, a control system corrects the position of the film web 8, 14 transverse to its transport direction. This can be done, for example, by using a device which is described in more detail by using FIG. 4. The correction is preferably carried out upstream of the sensor 39.

Figure 4:
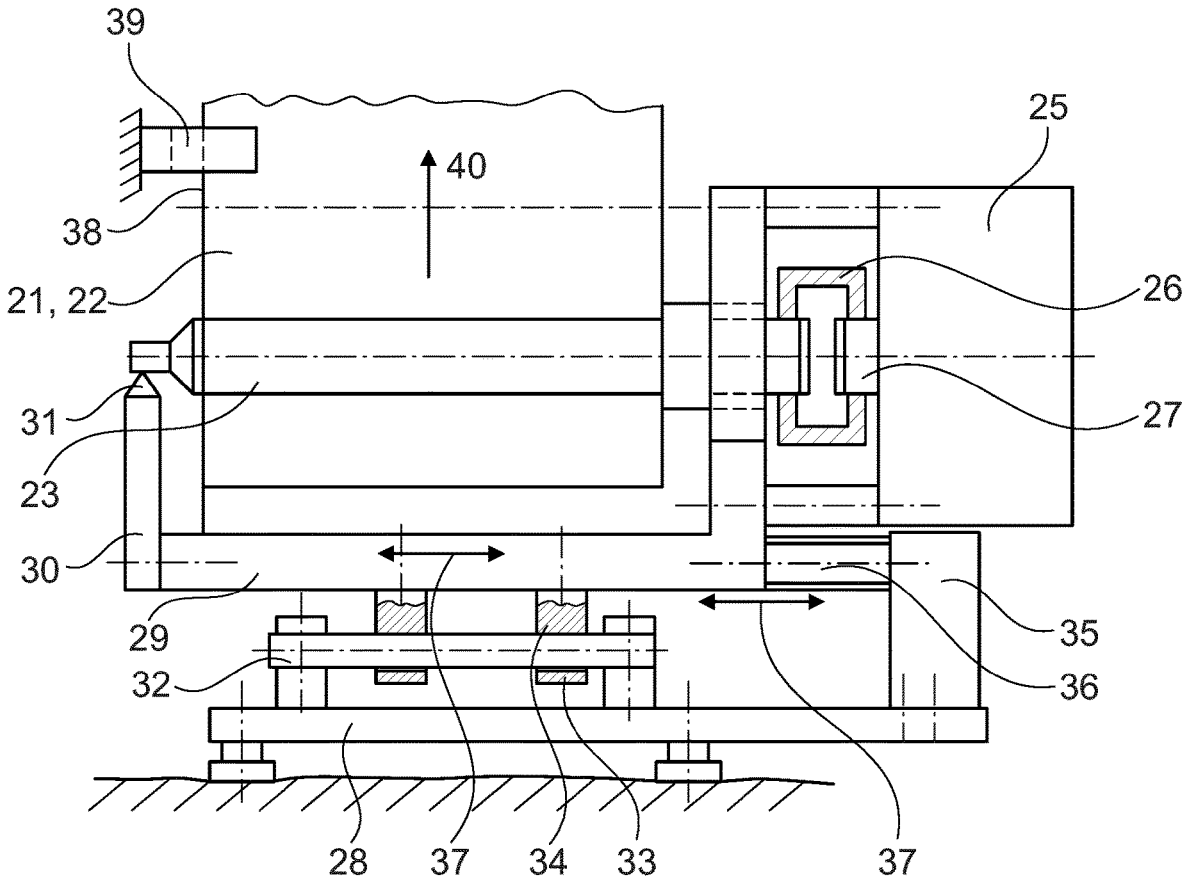
FIG. 4 shows the material web unwind of a packaging machine.

FIG. 4 shows a further embodiment of the packaging machine, wherein reference can substantially be made to the explanations according to FIG. 1. The supply roll 21, 22 is mounted on a shaft 23, preferably co-rotationally and/or not axially displaceably. As the lower and/or upper material web 8, 14 is unwound in the direction indicated by the arrow 40, the shaft 23 rotates. The shaft 23 is preferably rotatably and possibly also longitudinally displaceably mounted in the region of its two ends by means of a bearing 31. A bearing 31 can be provided, for example, on the housing of the material web unwind or on the packaging machine. For a longitudinal displacement, the bearings 31 can be implemented as sliding bearings. The shaft 23 is preferably driven in rotation by means of a motor 25. Between the motor 25 and the shaft 23, a coupling 26, for example a disk clutch or a gear mechanism, preferably a disk gear mechanism, can be provided. The invention provides for the shaft 23 on its own and/or the frame 29 on which the shaft 23 of the material web unwind is supported, to be longitudinally displaceable, which is symbolized by the arrow 37, and/or transverse to the transport direction 40 of the material web. For the purpose, for example, the frame 29 on which the shaft 23 and the motor 25 are provided is provided to be longitudinally displaceable, for example along a guide 32. The movement 37 is effected by an adjustment drive 35, for example, which moves at least the shaft 23 along its mid-axis but preferably additionally also the frame 29. Those skilled in the art will understand that the drive motor 25 can also be moved during the longitudinal displacement but does not have to be. The mounting 32-34 is preferably arranged on an in particular stationary base frame 28.

Preferably, the packaging machine according to the invention has a sensor 39, which is preferably a web edge detection means. Said web edge detection means 39 detects the position of the web edge, for example relative to the frame of the packaging machine or another preferably stationary location. Should the web edge be located on the other side of a desired limit, the adjustment drive 35 is preferably activated, then moving the shaft 23 or the frame 29 in the direction symbolized by the arrows 37 until the material web is once more located within the desired limit.

During start-up or during a supply roll change, the signal from the sensor can also be used to correct the axial position of the roll on the shaft 23.

LIST OF DESIGNATIONS

1 Packaging machine
2 Forming station, deep-drawing station
3 Upper tool of the deep-drawing station
4 Lower tool of the deep-drawing station
5 Lifting table, carrier of a tool of the sealing, deep-drawing station and/or the cutting device
6 Packaging recess
7 Filling station
8 Material web, lower material web, material web
9 Lifting device
10 Drive
11 Lower tool of the sealing station
12 Upper tool of the sealing station
13 Heating means
14 Upper material web, covering film, material web
15 Sealing station

16 Product to be packaged
17 Longitudinal cutter
18 Cross-cutter
19 Entry region
20 Dancer
21 Supply roll of the upper material web
22 Supply roll of the lower material web
23 Shaft of the supply roll
24 Chain
25 Motor, torque motor
26 Coupling, disk clutch
27 Motor shaft
28 Base frame, packaging machine
29 Support, displaceable frame
30 Door, bearing housing, frame
31 Bearing, sliding bearing
32 Guide, guide rod
33 Bearing, sliding bearing
34 Bearing block, bearing housing
35 Adjustment drive, motor, geared motor, spindle motor, servo motor
36 Spindle, shaft, adjustment means, displacement means
37 Adjustment direction, displacement direction
38 Reference point, web edge, material web edge, material web edge
39 Sensor, web edge detection means
40 Transport direction, material web running direction, web running direction
41 Mid-axis of the packaging machine
42 Clamping means, gripper
43 Distance between the material web edge and the packaging machine center
44 Distance between the material web edge and the chain
45 Distance between the material web edge and the base frame
46 Run-out of the material web

The invention claimed is:

1. A method for controlling a position of a lower material web on a packaging machine, the method comprising:

unwinding the lower material web from a first supply roll, transporting the lower material web in a transport direction intermittently or continuously along the packaging machine by two chain runs, the lower material web comprises a reference point, the reference point is an edge of the lower material web, a printed mark, and/or a printed image, forming one or more packaging recesses in the lower material web in a forming station, which is located downstream from the first supply roll, filling the one or more packaging recesses with one or more products to be packaged, sealing an upper material web to the lower material web in a sealing station, the upper material web being unwound from a second supply roll, detecting, by a first sensor located upstream from an entry region of the two chain runs before grippers of the two chain runs clamp the lower material web, a position of the reference point on the lower material web, and based on the detected position of the reference point on the lower material web, adjusting the position of the lower material web by axially moving the first supply roll in a direction transverse to the transport direction of the lower material web, wherein the two chain runs extend from a region of the packaging machine that is upstream of the forming station to a region of the packaging machine that is downstream of the sealing station, wherein the lower material web is mounted on a shaft that rotates as the lower material web is unwound from the first supply roll, the shaft is driven by a motor, the shaft is supported on a frame that is connected to a guide by a slide bearing and that is displaceable along a length of the guide in the direction transverse to the transport direction, wherein the frame is longitudinally displaceable by an adjustment drive, wherein the packaging machine comprises a coupling between the motor and the shaft to allow the shaft and the frame to be longitudinally movable along an axis of rotation of the first supply roll during the step of adjusting the position of the lower material web, wherein one of the two chain runs is arranged on a right side of the lower material web and the other of the two chain runs is arranged on a left side of the lower material web, the grippers clamp the edge of the lower material web, wherein the method comprises transmitting a signal from the first sensor to a control/regulating system, which evaluates the signal before the step of adjusting the position of the lower material web, the first sensor being arranged adjacent to the first supply roll, wherein the upper material web comprises a reference point, and the method comprises detecting, by a second sensor, a position of the reference point on the upper material web, and based on the detected position of the reference point on the upper material web, the method comprises a step of adjusting a position of the upper material web by moving the second supply roll in the direction transverse to the transport direction, wherein the lower material web has a width between 200 millimeters and 1 meter, wherein a position of the first sensor is adjustable to account for a decreasing diameter of the first supply roll, and wherein the method comprises determining a distance between the reference point on the lower material web and a center of the packaging machine, a frame of the packaging machine, and/or the two chain runs.

2. The method as claimed in claim 1, wherein the first sensor is vertically and/or longitudinally adjustable.

3. The method as claimed in claim 1, wherein the method comprises correcting a run-out of the lower material web.

4. The method as claimed in claim 1, wherein deviations of a nominal width and/or deviations of parallelism of the edge of the lower material web relative to the transport direction are compensated.

5. The method as claimed in claim 1, wherein the method comprises displaying a target position and/or an actual position of the lower material web roll.

6. The method as claimed in claim 1, wherein the method comprises using data from the first sensor to rectify an error message, wherein the error message is generated upon at least one occurrence selected from a group of:

a lateral adjustment range of a regulating system of the packaging machine has been reached or exceeded;

a detected trend cannot be stopped or reversed;

the first sensor detects that the lower material web has a wrong width;

the lower material web has been mounted incorrectly on the packaging machine.

7. The method as claimed in claim 6, wherein the method comprises carrying out a trend analysis using data determined by the first sensor.

8. The method as claimed in claim 7, wherein the first sensor is a touch sensor.

9. The method as claimed in claim 1, wherein the method comprises carrying out a trend analysis using data determined by the first sensor.

10. The method as claimed in claim 1, wherein the method comprises using data from the first sensor to rectify an error message.

11. The method as claimed in claim 1, wherein the first sensor is a touch sensor.

* * * * *